US009033195B1

(12) United States Patent
Martinez-Ramos

(10) Patent No.: US 9,033,195 B1
(45) Date of Patent: May 19, 2015

(54) GLOVE DRYING BASKET ASSEMBLY

(71) Applicant: Nancy Y. Martinez-Ramos, Sacramento, CA (US)

(72) Inventor: Nancy Y. Martinez-Ramos, Sacramento, CA (US)

( * ) Notice: Subject to any disclaimer, the term of this patent is extended or adjusted under 35 U.S.C. 154(b) by 45 days.

(21) Appl. No.: 13/804,897

(22) Filed: Mar. 14, 2013

(51) Int. Cl.

| | |
|---|---|
| ***A47G 29/08*** | (2006.01) |
| ***D06F 59/04*** | (2006.01) |
| ***A47G 25/00*** | (2006.01) |
| *D06F 73/00* | (2006.01) |

(52) U.S. Cl.
CPC ..... *A47G 25/00* (2013.01)

(58) Field of Classification Search
CPC ..... D06F 50/00; D06F 50/02; D06F 50/04; A63B 71/141; A41D 19/00; B27J 1/00
USPC ..... 223/78, 79, 80; 147/48; 220/485, 487; 211/37, 85.3; 34/103–105; D32/58, 59; D6/674
See application file for complete search history.

(56) References Cited

U.S. PATENT DOCUMENTS

| | | | | |
|---|---|---|---|---|
| 1,524,014 | A * | 1/1925 | Boorstin | 220/485 |
| 1,591,336 | A * | 7/1926 | Printz | 220/485 |
| 2,440,398 | A * | 4/1948 | Fenwick | 34/105 |
| 2,666,549 | A * | 1/1954 | Horne, Jr. | 220/487 |
| 3,133,682 | A | 5/1964 | Sawyer | |
| 3,409,142 | A | 11/1968 | Mechaneck | |
| 3,589,522 | A * | 6/1971 | Chiodo | 211/34 |
| 4,689,897 | A * | 9/1987 | Marsalona | 34/103 |
| 4,991,756 | A * | 2/1991 | Benjamin | 223/72 |
| 5,125,169 | A | 6/1992 | Bader | |
| 5,406,717 | A | 4/1995 | Dofka | |
| 5,592,750 | A * | 1/1997 | Eichten | 34/104 |
| 6,076,713 | A | 6/2000 | Boudreau et al. | |
| 6,327,792 | B1 * | 12/2001 | Hebert | 34/104 |
| 6,766,591 | B1 * | 7/2004 | McKinney et al. | 34/104 |
| D544,670 | S | 6/2007 | Sorvill | |
| D563,070 | S * | 2/2008 | Palese et al. | D32/59 |
| 2004/0181963 | A1 | 9/2004 | Morris | |
| 2010/0314343 | A1 * | 12/2010 | O'Leary et al. | 211/85.3 |

* cited by examiner

*Primary Examiner* — Ismael Izaguirre

(57) ABSTRACT

A glove drying basket assembly holds gloves in a position maximizing air flow in and around the gloves to promote drying. The assembly includes a basket having a bottom wall and a perimeter wall extending upwardly from a perimeter edge of the bottom wall. A handle is coupled to the basket. At least one glove holder is coupled to the basket. The glove holder has a palm section and a plurality of finger sections coupled to and extending from the palm section. The glove holder also has an open bottom end and a plurality of openings in environmental communication with the open bottom end. The openings are positioned in spaced relationship over and around the palm section and each of the finger sections wherein the glove holder is configured to provide air flow to a palm and each finger of a glove positioned over the glove holder.

20 Claims, 5 Drawing Sheets

GLOVE DRYING BASKET ASSEMBLY

BACKGROUND OF THE DISCLOSURE

Field of the Disclosure

The disclosure relates to glove rack devices and more particularly pertains to a new glove rack device for storing and transporting gloves in a position maximizing air flow in and around the gloves to promote drying of the gloves.

SUMMARY OF THE DISCLOSURE

An embodiment of the disclosure meets the needs presented above by generally comprising a basket having a bottom will and a perimeter wall extending upwardly from a perimeter edge of the bottom wall. A handle is coupled to the basket. At least one glove holder is coupled to the basket. The glove holder has a palm section and a plurality of finger sections coupled to and extending from the palm section. The glove holder also has an open bottom end and a plurality of openings in environmental communication with the open bottom end. The openings are positioned in spaced relationship over and around the palm section and each of the finger sections wherein the glove holder is configured to provide air flow to a palm and each finger of a glove positioned over the glove holder.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
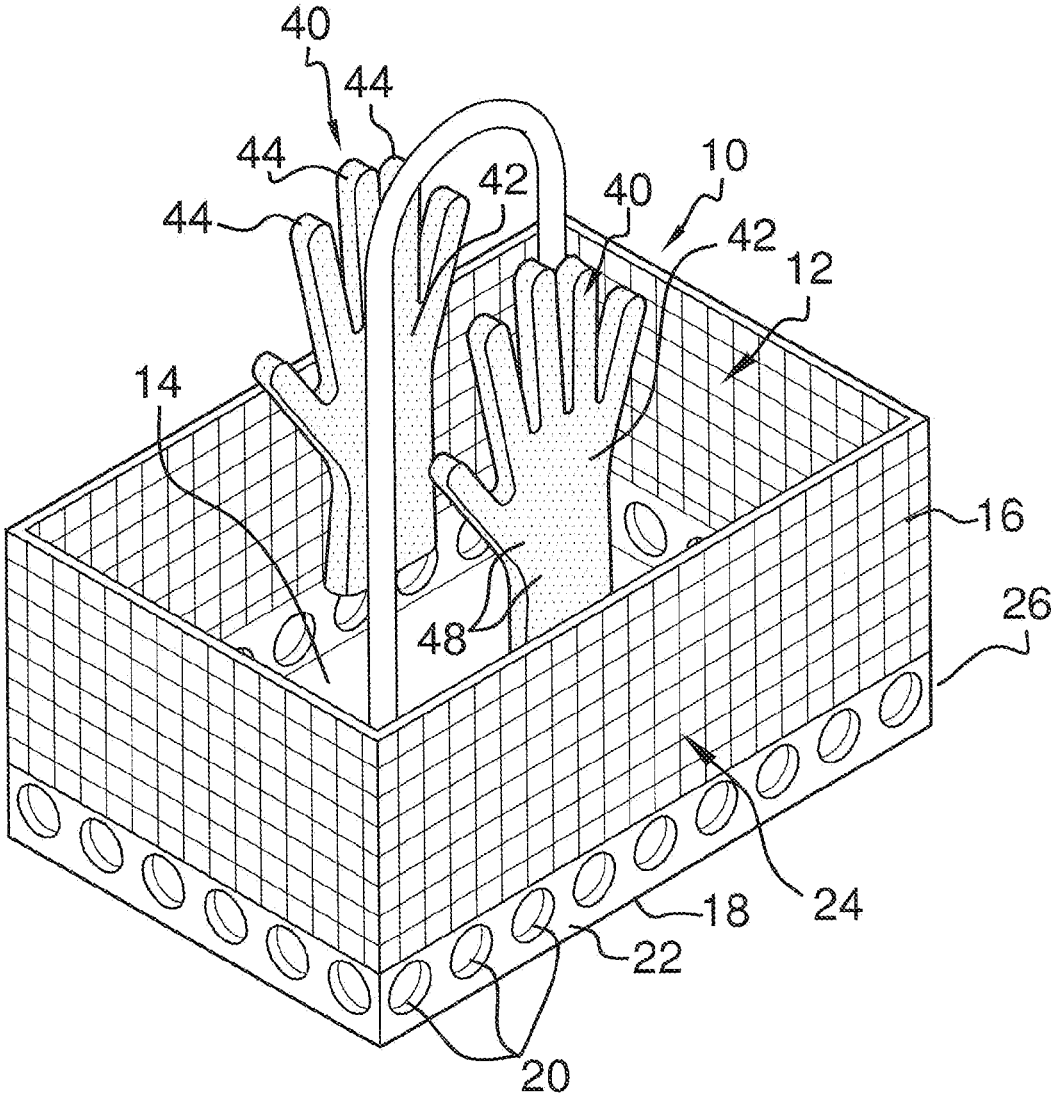
FIG. 1 is a top front side perspective view of a glove drying basket assembly according to an embodiment of the disclosure.
Figure 2:
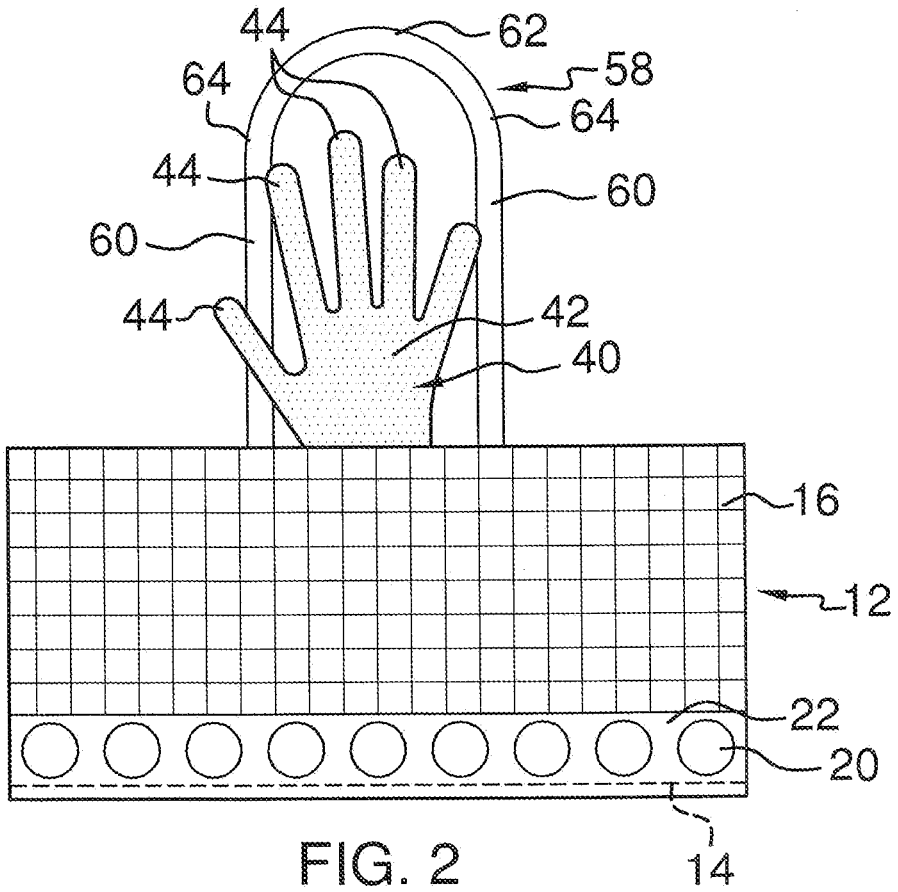
FIG. 2 is a front view of an embodiment of the disclosure.
Figure 3:
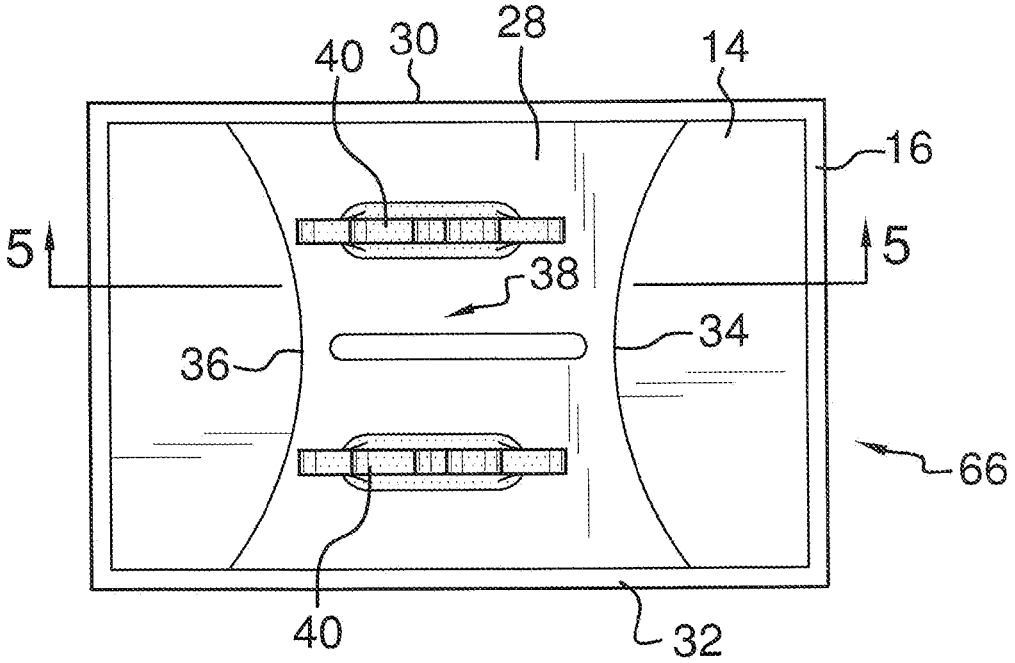
FIG. 3 is a top view of an embodiment of the disclosure.
Figure 4:
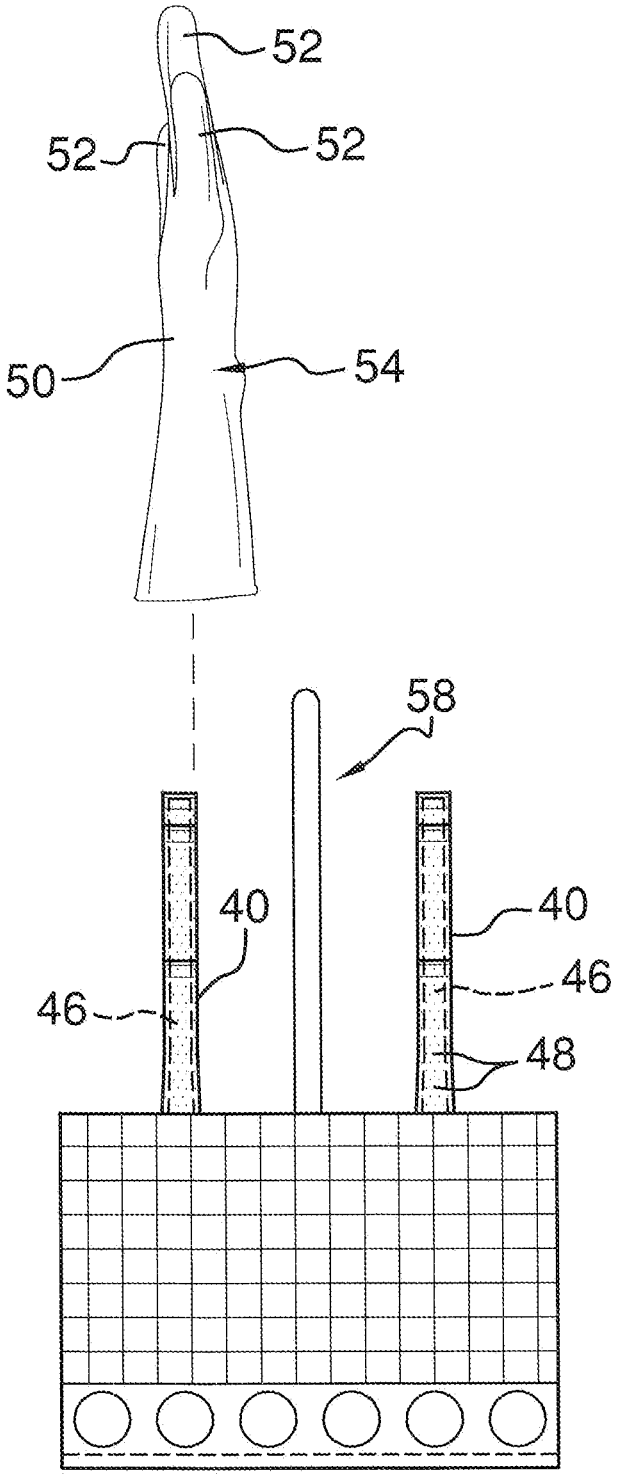
FIG. 4 is a side view of an embodiment of the disclosure.
Figure 5:
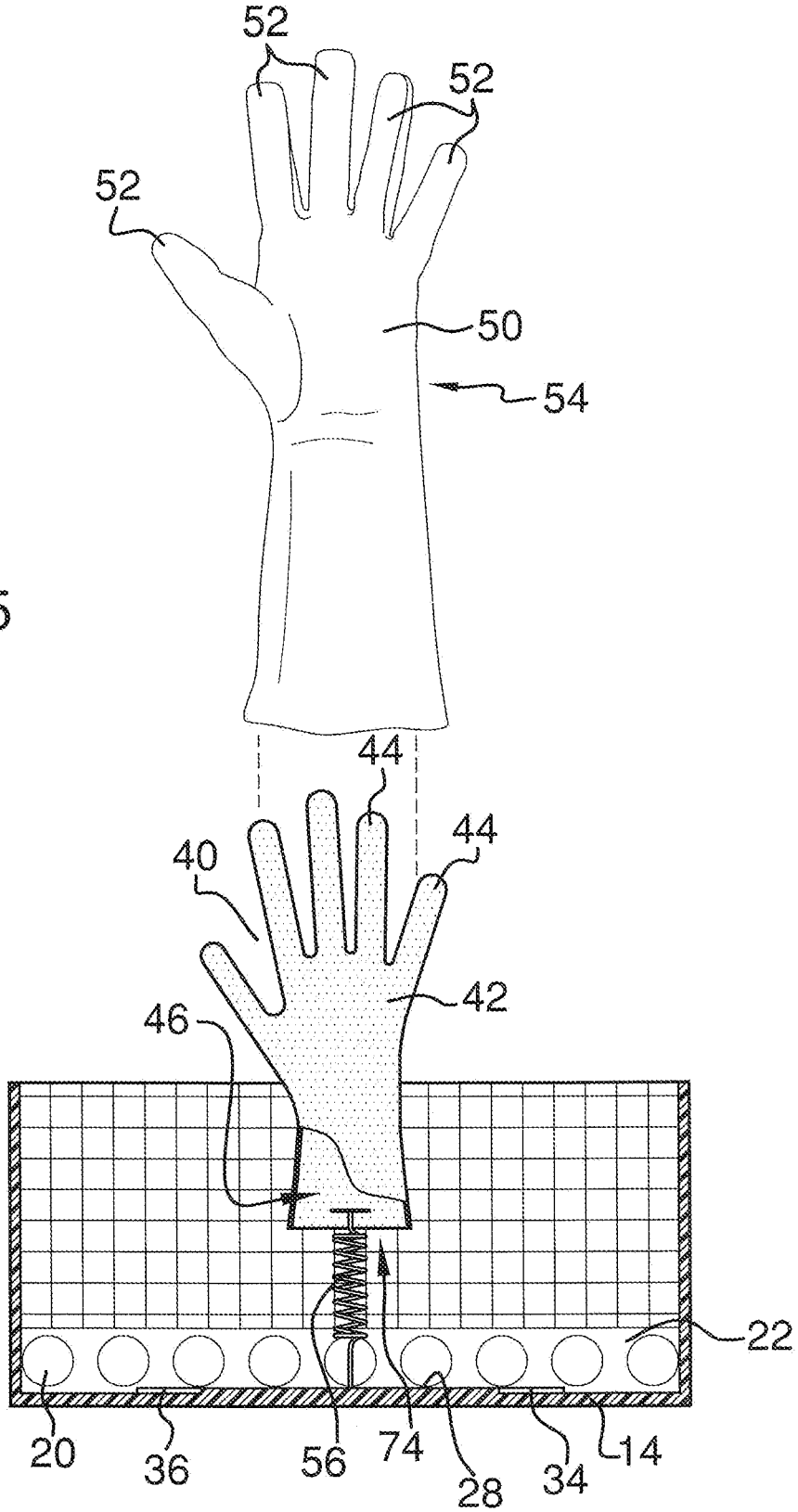
FIG. 5 is a cross-sectional view of an embodiment of the disclosure taken along line 5-5 of FIG. 3.

With reference now to the drawings, and in particular to FIGS. 1 through 6 thereof, a new glove rack device embodying the principles and concepts of an embodiment of the disclosure and generally designated by the reference numeral 10 will be described.

As best illustrated in FIGS. 1 through 6, the glove drying basket assembly 10 generally comprises a basket 12 having a bottom wall 14 and a perimeter wall 16 extending upwardly from a perimeter edge 18 of the bottom wall 14. The basket 12 may have a plurality of apertures 20 extending through a bottom portion 22 of the perimeter wall 16 of the basket 12. The apertures 20 may be round. An upper portion 24 of the basket 12 may be formed of a screen material or netting providing a plurality of square openings each being smaller than one of the apertures 20. The apertures 20 are positioned in a line 26 extending around the perimeter wall 16 proximate the perimeter edge 18 of the bottom wall 14. The bottom wall 14 may have a raised medial section 28 extending between opposed sides 30,32 of the perimeter wall 16. Side edges 34,36 of the raised medial section 28 may be arcuate and bowing inwardly towards a middle 38 of the bottom wall 14.

A pair of glove holders 40 is coupled to the basket 12. Each glove holder 40 has a palm section 42 and a plurality of finger sections 44 coupled to and extending from the palm section 42. The palm section 42 may be elongated providing support for a long glove which would cover a wrist and lower forearm of a person wearing the glove. Each glove holder 40 has an open bottom end 44, a hollow interior 46 and a plurality of openings 48 in environmental communication with the open bottom end 74 of the glove holder 40. The openings 48 of each glove holder 40 are positioned in spaced relationship over and around the palm section 42 and each of the finger sections 44 wherein each glove holder 40 is configured to provide air flow to a palm 50 and each finger 52 of a glove 54 positioned over the glove holder 40.

A pair of biasing members 56 is provided. Each biasing member 56 is coupled to and extends between the raised medial section 28 of the bottom wall 14 of the basket 12 and an associated one of the glove holders 40.

A handle 58 is coupled to the basket 12. The handle 58 has a pair of parallel side portions 60 and an arcuate medial portion 62 extending between upper ends 64 of the side portions 60 of the handle 58. Lower ends 68 of each of the side portions 60 of the handle 58 are coupled to the raised medial section 28 of the bottom wall 14 of the basket 12. The handle 58 may be positioned between and positioned parallel to the pair of glove holders 40.

Figure 6:
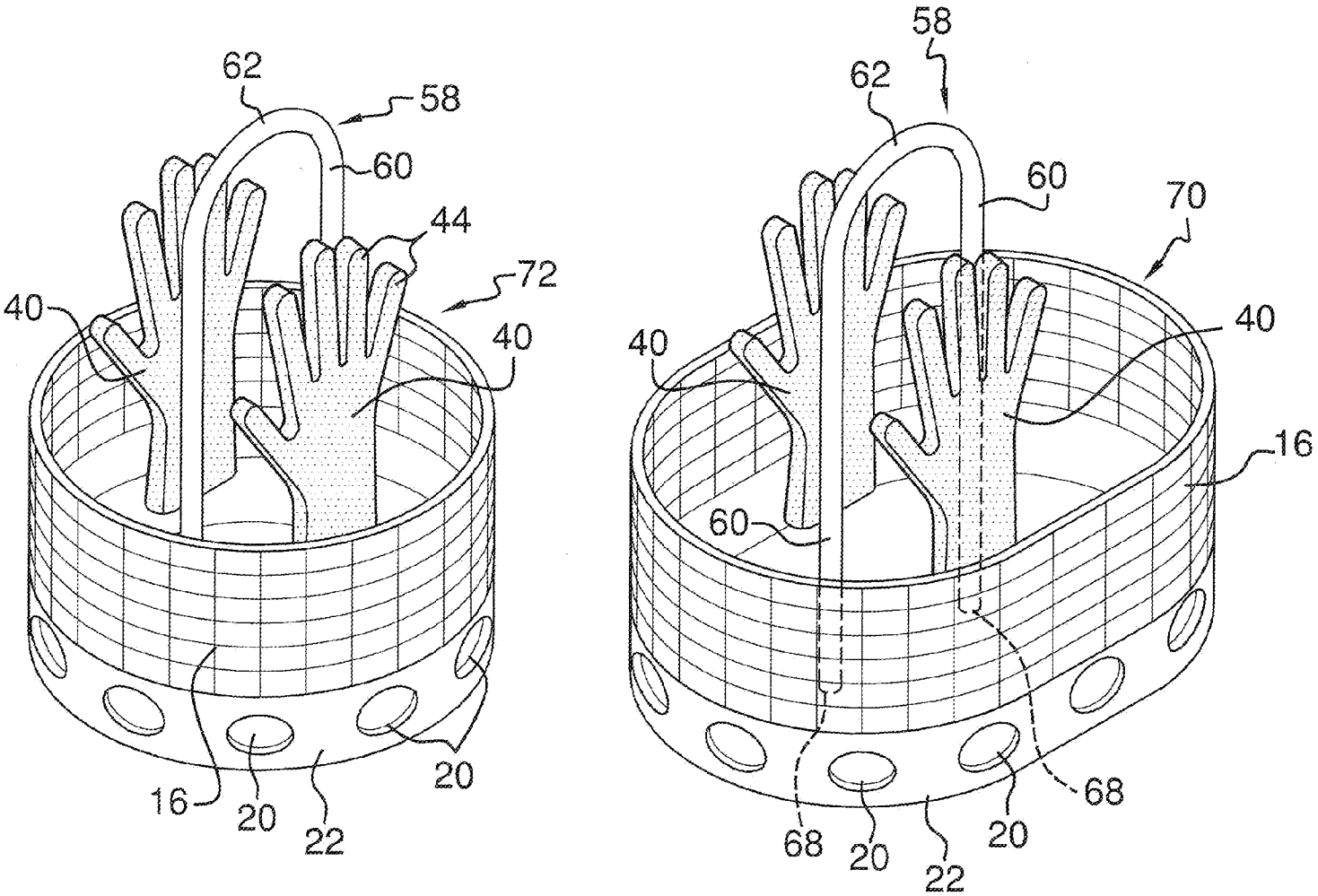
FIG. 6 is a top front side perspective view of embodiments of the disclosure.

The perimeter wall 16 may have a rectangular cross-sectional shape 66 taken parallel to the bottom wall 14 of the basket 12. The rectangular shape 66 may include a square shape having equal length sides. As shown in FIG. 6, the basket 12 may have a substantially oval cross-sectional shape 70 or a substantially round cross-sectional shape 72 taken parallel to the bottom wall 14 of the basket 12.

In use, work gloves, winter gloves or any other glove may be positioned on the glove holders 40 in the basket 12 holding the gloves 54 in a spread position and promoting air flow into and through the gloves 54 to dry each glove 54 thoroughly between uses. The medial portion 62 of the handle 58 may extend above a top edge 76 of the basket 12 and the glove holders 40 to permit attaching the basket 12 to a pole, hook, or other device for storage or transport.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A glove drying basket assembly comprising:

a basket having a bottom wall and a perimeter wall extending upwardly from a perimeter edge of said bottom wall;

a handle coupled to said basket;

at least one glove holder coupled to said basket, said glove holder having a palm section and a plurality of finger sections coupled to and extending from said palm section, said glove holder having an open bottom end and a plurality of openings in environmental communication with said open bottom end, said openings being positioned in spaced relationship over and around said palm section and each of said finger sections wherein said glove holder is configured to provide air flow to a palm and each finger of a glove positioned over said glove holder; and a biasing member coupled to and extending between said bottom wall of said basket and said glove holder.

2. The assembly of claim 1, further comprising said basket having a plurality of apertures, said apertures extending through said perimeter wall of said basket.

3. The assembly of claim 2, further comprising said apertures being positioned in a line extending around said perimeter wall proximate said perimeter edge of said bottom wall.

4. The assembly of claim 1, further comprising said perimeter wall having a rectangular cross-sectional shape taken parallel to said bottom wall of said basket.

5. The assembly of claim 1, further comprising said perimeter wall having a substantially oval cross-sectional shape taken parallel to said bottom wall of said basket.

6. The assembly of claim 1, further comprising said perimeter wall having a substantially round cross-sectional shape taken parallel to said bottom wall of said basket.

7. The assembly of claim 1, further comprising a pair of said glove holders being coupled to said basket.

8. The assembly of claim 7, further comprising said handle having a pair of parallel side portions and an arcuate medial portion extending between upper ends of said side portions of said handle.

9. The assembly of claim 8, further comprising said handle being positioned between and positioned parallel to said pair of glove holders.

10. The assembly of claim 8, further comprising lower ends of each of said side portions of said handle being coupled to said bottom wall of said basket.

11. The assembly of claim 1, further comprising said bottom wall having a raised medial section extending between opposed sides of said perimeter wall.

12. The assembly of claim 11, further comprising side edges of said raised medial section being arcuate and bowing inwardly towards a middle of said bottom wall.

13. A glove drying basket assembly comprising:

a basket having a bottom wall and a perimeter wall extending upwardly from a perimeter edge of said bottom wall, said basket having a plurality of apertures, said apertures extending through a bottom portion of said perimeter wall of said basket, said apertures being positioned in a line extending around said perimeter wall proximate said perimeter edge of said bottom wall, said bottom wall having a raised medial section extending between opposed sides of said perimeter wall, side edges of said raised medial section being arcuate and bowing inwardly towards a middle of said bottom wall;

a pair of glove holders coupled to said basket, each said glove holder having a palm section and a plurality of finger sections coupled to and extending from said palm section, each said glove holder having an open bottom end and a plurality of openings in environmental communication with said open bottom end of said glove holder, said openings of each said glove holder being positioned in spaced relationship over and around said palm section and each of said finger sections wherein each said glove holder is configured to provide air flow to a palm and each finger of a glove positioned over said glove holder;

a pair of biasing members, each biasing member being coupled to and extending between said raised medial section of said bottom wall of said basket and an associated one of said glove holders;

a handle coupled to said basket, said handle having a pair of parallel side portions and an arcuate medial portion extending between upper ends of said side portions of said handle, lower ends of each of said side portions of said handle being coupled to said raised medial section of said bottom wall of said basket, said handle being positioned between and positioned parallel to said pair of glove holders.

14. The assembly of claim 13, further comprising said perimeter wall having a rectangular cross-sectional shape taken parallel to said bottom wall of said basket.

15. The assembly of claim 13, further comprising said perimeter wall having a substantially oval cross-sectional shape taken parallel to said bottom wall of said basket.

16. The assembly of claim 13, further comprising said perimeter wall having a substantially round cross-sectional shape taken parallel to said bottom wall of said basket.

17. A glove drying basket assembly comprising:

a basket having a bottom wall and a perimeter wall extending upwardly from a perimeter edge of said bottom wall, said bottom wall having a raised medial section extending between opposed sides of said perimeter wall;

a handle coupled to said basket; and at least one glove holder coupled to said basket, said glove holder having a palm section and a plurality of finger sections coupled to and extending from said palm section, said glove holder having an open bottom end and a plurality of openings in environmental communication with said open bottom end, said openings being positioned in spaced relationship over and around said palm section and each of said finger sections wherein said glove holder is configured to provide air flow to a palm and each finger of a glove positioned over said glove holder.

18. The assembly of claim 17, further comprising said basket having a plurality of apertures, said apertures extending through said perimeter wall of said basket, said apertures being positioned in a line extending around said perimeter wall proximate said perimeter edge of said bottom wall.

19. The assembly of claim 17, further comprising a pair of said glove holders being coupled to said basket.

20. The assembly of claim 17, further comprising side edges of said raised medial section being arcuate and bowing inwardly towards a middle of said bottom wall.

* * * * *